US010669746B2

(12) United States Patent
Nguyen

(10) Patent No.: US 10,669,746 B2
(45) Date of Patent: Jun. 2, 2020

(54) MULTI-FUNCTION LATCH AND LATCH BOLT

(71) Applicant: Trung T Nguyen, Plano, TX (US)

(72) Inventor: Trung T Nguyen, Plano, TX (US)

( * ) Notice: Subject to any disclaimer, the term of this patent is extended or adjusted under 35 U.S.C. 154(b) by 1350 days.

(21) Appl. No.: 14/805,479

(22) Filed: Jul. 22, 2015

(65) Prior Publication Data

US 2017/0022736 A1 Jan. 26, 2017

Related U.S. Application Data

(60) Provisional application No. 62/028,283, filed on Jul. 23, 2014.

(51) Int. Cl.

| | |
|---|---|
| ***E05B 63/04*** | (2006.01) |
| ***E05B 65/06*** | (2006.01) |
| ***E05B 65/08*** | (2006.01) |
| ***E05B 63/00*** | (2006.01) |
| ***E05B 55/00*** | (2006.01) |
| ***E05B 57/00*** | (2006.01) |
| ***E05B 65/00*** | (2006.01) |

(52) U.S. Cl.

CPC ..... *E05B 63/0004* (2013.01); *E05B 55/00* (2013.01); *E05B 57/00* (2013.01); *E05B 63/0034* (2013.01); *E05B 65/0007* (2013.01); *E05B 65/06* (2013.01); *E05B 65/087* (2013.01)

(58) Field of Classification Search

CPC ..... E05B 55/00; E05B 57/00; E05B 63/0004; E05B 63/0034; E05B 65/0007; E05B 65/06; E05B 65/087

USPC ..... 292/137

See application file for complete search history.

(56) References Cited

U.S. PATENT DOCUMENTS

| | | | | | |
|---|---|---|---|---|---|
| 790,637 | A * | 5/1905 | Jones | E05B 15/0093 | 292/136 |
| 844,907 | A * | 2/1907 | Aiken | E05B 15/0093 | 292/136 |
| 2,461,398 | A * | 2/1949 | Sands | E05C 19/182 | 292/290 |
| 4,178,025 | A * | 12/1979 | Robins | E05C 3/14 | 292/117 |
| 4,451,072 | A * | 5/1984 | Petty, Sr. | E05C 3/14 | 292/104 |
| 4,690,440 | A * | 9/1987 | Rogers | E05B 65/0007 | 292/205 |
| 4,871,203 | A * | 10/1989 | Rogers | E05C 3/14 | 292/238 |
| 4,887,854 | A * | 12/1989 | Bulten | E05C 3/14 | 292/238 |

(Continued)

*Primary Examiner* — Joshua E Rodden

(57) ABSTRACT

A multi-function latch and latch bolt includes a pair of mechanical fastener to be installed on a gate for the purpose of holding the gate in closed position, and that a person standing on the inside of the fence can disengage the latch hook bracket from the latch bolt, or disengage the latch bolt from the latch hook bracket in any of which method to unlatch and open the gate from inside the fence even when the outside of the latch is locked. On the other hand, when the latch is not locked on the inside but locked on the outside with an incorporated lock, keyed or combination padlock; then a person standing on the outside of the gate may open the gate if he/she has an appropriate key or knows the combination codes in order to unlock, unlatch and open the gate from outside the fence.

15 Claims, 13 Drawing Sheets

(56) References Cited

U.S. PATENT DOCUMENTS

| | | | | |
|---|---|---|---|---|
| 6,471,261 | B1 * | 10/2002 | Messler | E05B 65/0007 292/205 |
| 10,221,621 | B2 * | 3/2019 | Marcinik | E06B 9/174 |
| 2010/0148523 | A1 * | 6/2010 | Tai | E05B 17/2038 292/236 |
| 2013/0270842 | A1 * | 10/2013 | Martin | E05C 3/14 292/210 |
| 2018/0371801 | A1 * | 12/2018 | Benson | E05B 65/0007 |

* cited by examiner

MULTI-FUNCTION LATCH AND LATCH BOLT

FIELD OF THE INVENTION

The present invention relates to new and improved functionality of latches and latch bolts for use on fence gates or doors. More particularly, but not exclusively, the present invention relates to a gate latch and latch bolt for installing on a wood gate and/or fence frame, wood or metal door where a person can unlatch from inside the fence even when the outside of the latch is locked with an incorporated lock, a third party keyed or combination padlock or the like to prevent a person from being locked in; On the other hand, a person standing on the outside of the gate may unlatch the gate or door when the latch is not locked on either side; however, when the latch is locked only on the outside with an incorporated lock, a keyed or combination padlock, then a person is required to have an appropriate key or know the combination codes in order to unlock, unlatch and then open the gate from outside the fence; the gate latch can be locked on the inside of the fence with a padlock, an incorporated secondary locking bolt on the base plate or simply tie a wire at the lock holes to prevent the latch-hook bracket from being lifted by the handle bar on the outside of the fence.

BACKGROUND OF THE INVENTION

Fences are constructed as a means of providing security, safety and privacy as well as restricting or preventing trespassing, burglary or unauthorized persons from entering into the enclosed area, such as a backyard, garden, barn or any enclosed outdoor fenced structure; however, an enclosed fence usually have at least one gate for entrance or exit. Swing gates are generally used on residential fences, and sliding gates are generally used on residential and commercial fences where a person may enter or exit the enclosed areas. Deterring would-be burglar or unauthorized person is one of the most effective forms of crime prevention. Having a bold latching system mounted and locked on a gate will hopefully prevent burglars or unauthorized person from entering. A mechanical fastener such as a latch and latch bolt are utilized to hold the gate in closed position and yet to allow the gate to swing or slide open when being unlatched. Normally, when a homeowner uses a padlock for the gate latch on the inside to prevent someone on the outside of the fence from entering into the enclosed area, but if the homeowner wants to give access to certain person such as a relative or a trusted house cleaner, a padlock has to be installed on the outside of the gate latch instead of on the inside; therefore, the person on the outside must have an appropriate key or know the combination codes for the padlock; unfortunately, as when the latch is locked on the outside, the homeowner on the inside cannot open the gate and therefore being locked in or has to find an alternative way to get to the outside of the fence to unlock the padlock in order to unlatch and open the gate from outside.

Currently, there is no known prior latch and latch bolt offering the solution to the problem. It is, therefore, an object of the invention to provide a new solution to a long-time problem that allows certain person to gain access from outside the fence, and a person on the inside of the fence can open the gate even when the gate latch is locked on the outside.

SUMMARY OF THE INVENTION

While a gate latch is locked on the outside of the fence, a person on the inside of the fence still can disengage the gate latch to open the gate by lifting the latch-hook bracket away from the latch bolt; or swinging the latch bolt pivotably or sliding the latch bolt horizontally away from the latch-hook bracket. A padlock can be used to lock the gate latch on the inside of the gate so that a person on the outside of the gate cannot open the gate; thereby, preventing any unauthorized person from entering. On the other hand, when a padlock is installed on the outside of the gate latch, only authorized person with an appropriate key or combination codes may unlock and unlatch the gate latch. An integral lock can be incorporated onto the gate latch or handle bar as an optional feature; for example, a cam lock is incorporated as a part of the gate latch for use with a key or combination code.

The present invention is directed to new and useful alternatives to known products and methods to help solving problem that the person standing on the inside of the gate cannot open the gate because the gate latch is locked on the outside.

BRIEF DESCRIPTIONS OF THE DRAWINGS

The subject matter regarded as the invention is specifically mentioned and claimed in the concluding portion of the specification. The invention, however, both as configuration and method of operation, together with features and functionalities thereof will be or become apparent to those skilled in the art upon reference to the following detailed description when read with the accompanying drawings. It is intended that any additional configurations, modifications, methods of operation, features or advantages ascertained by those skilled in the art be included within this description, be within the scope of the present invention and be protected by the accompanying claims.

In regard to these amended drawings, all these replacement sheets are re-numbered and the amendments are derived from the original claims:

DETAILED DESCRIPTION OF THE DRAWINGS

Figure 1:
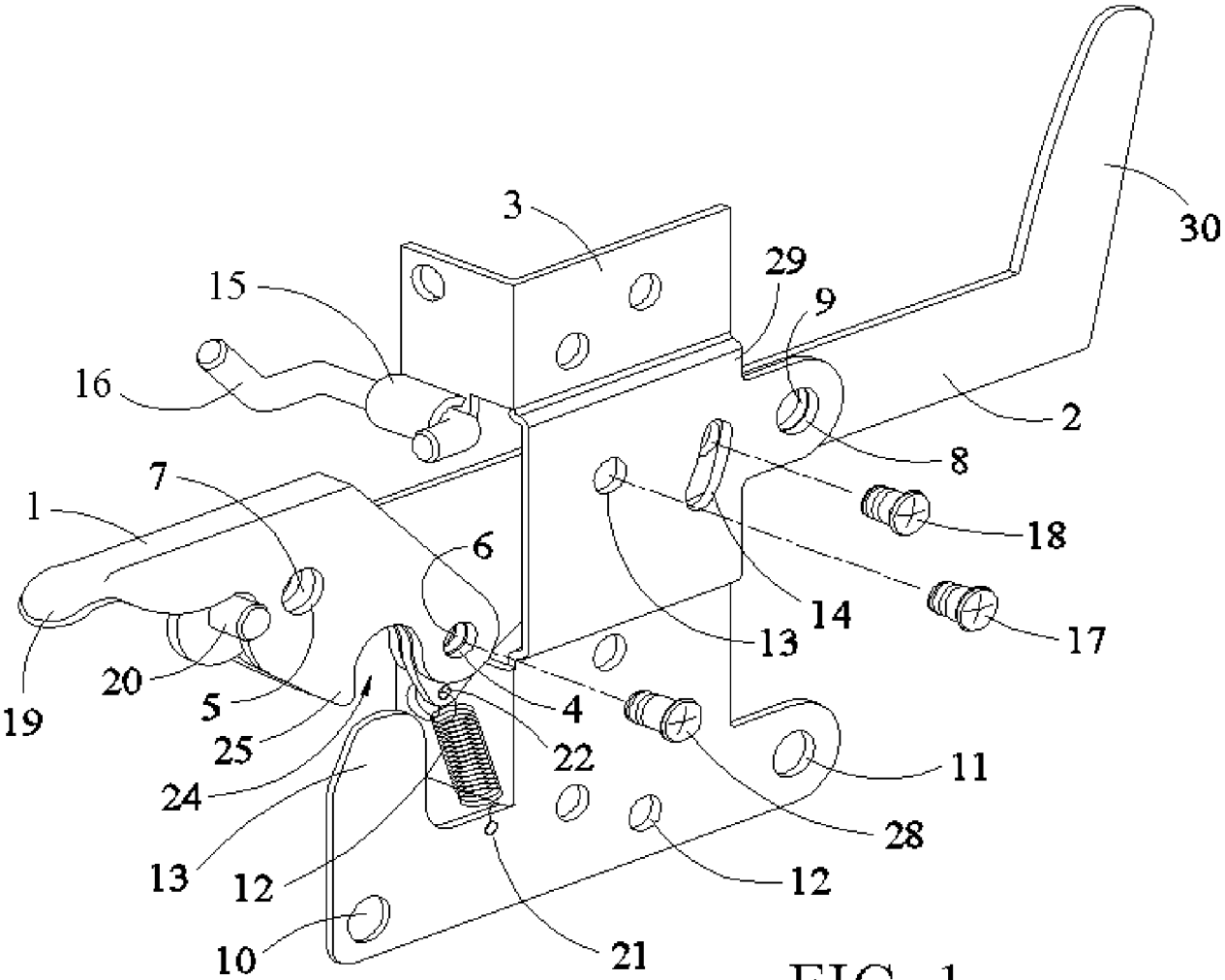
FIG. 1 is a dimetric view of the gate latch showing three major components including latch-hook bracket, handle bar and base bracket in latched position.

The followings are described as the preferred embodiments of the multi-function latch and latch bolt in accordance with the present invention. In describing the embodiments illustrated in the drawings, certain terminology will be used for consistency and clarity. The preferred embodiments of the gate latch contain four groups of drawings, each group has three drawings, and the embodiment of the latch bolt has one drawing. It will become evident to those skilled in the art that several objectives and advantages of this invention follow from the novel method by which a person inside the gate can unlatch the latch-hook bracket from the locking bolt or unlatch the locking bolt from the latch-hook bracket in order to open the gate even when the gate latch is locked on the outside of the fence with an incorporated lock or a padlock.

The gate latch comprises three major components including a base bracket, a handle bar and a latch-hook bracket; and the latch bolt comprises two major components including a base housing and a locking bolt. The latch-hook bracket is a general term used for describing a partially pivotable latch-hook bracket which is a double-hook structure or a single-hook structure that is pivotably attached to the inside portion of a partially pivotable handle bar or to the inside portion of the base bracket. The gate latch comes in at least four different embodiments; and the latch bolt comes in at least one embodiment and/or configured for specific latch mechanism. The base bracket and the handle bar are configured to accept a specific latch-hook bracket embodiment. The handle bar is pivotably attached to the base bracket at a pivot point where the base bracket and the handle bar are configured to work according to one of the preferred embodiments. The latch-hook bracket is pivotably attached to the inside portion of the handle bar where the user can lift the latch-hook bracket upwardly or push the latch-hook bracket downwardly to raise the hook tongue or locking-bolt pocket up in order to disengage the latch-hook bracket from the locking bolt, or disengage the locking bolt from the latch-hook bracket by sliding the locking bolt horizontally away from the latch-hook bracket or push the locking bolt downwardly away from the latch-hook bracket. The base bracket may comprise a lift-stop plate to prevent the locking bolt from being swung downwardly. The lift-stop plate can be configured so that the locking bolt can be swung vertically in a downward direction away from the latch-hook bracket. The gate can be unlatched from inside the gate even when the outside of the gate latch is locked.

Referring now to the figures, the preferred embodiments of the gate latch and latch bolt are being described. Certain features on one embodiment may be utilized for other embodiments. Latch-hook bracket is a general term describing a double-hook structure or a single-hook structure.

Figure 2:
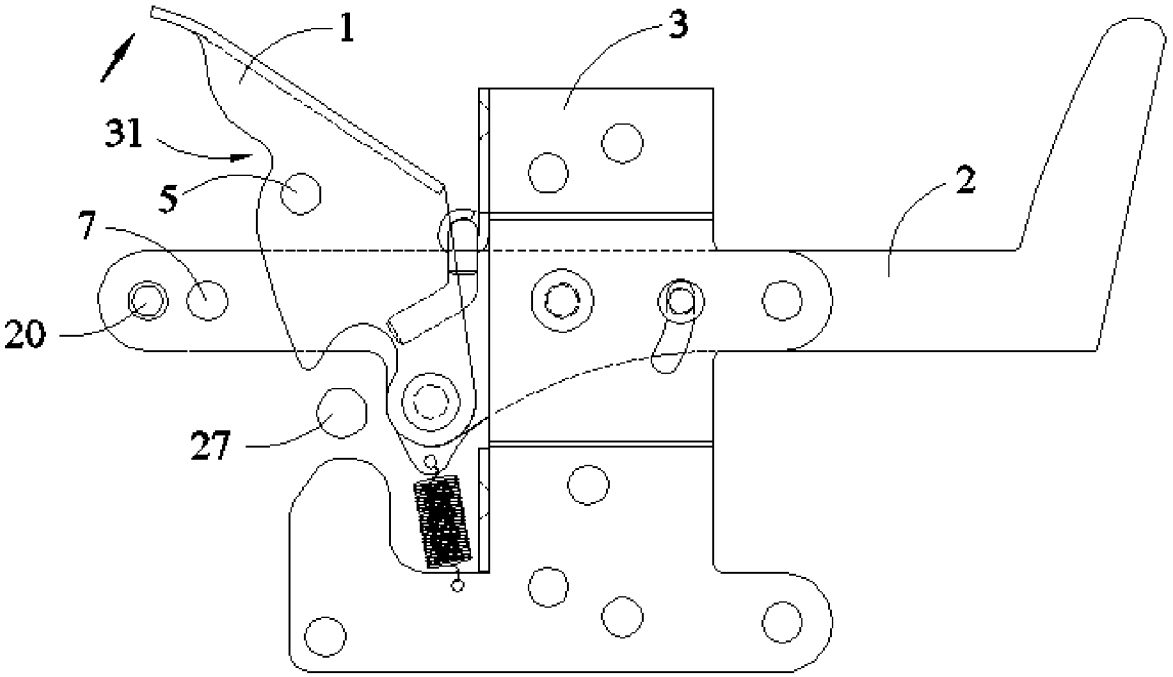
FIG. 2 is a 2-dimensional view showing the latch-hook bracket being lifted out of latched position.
Figure 3:
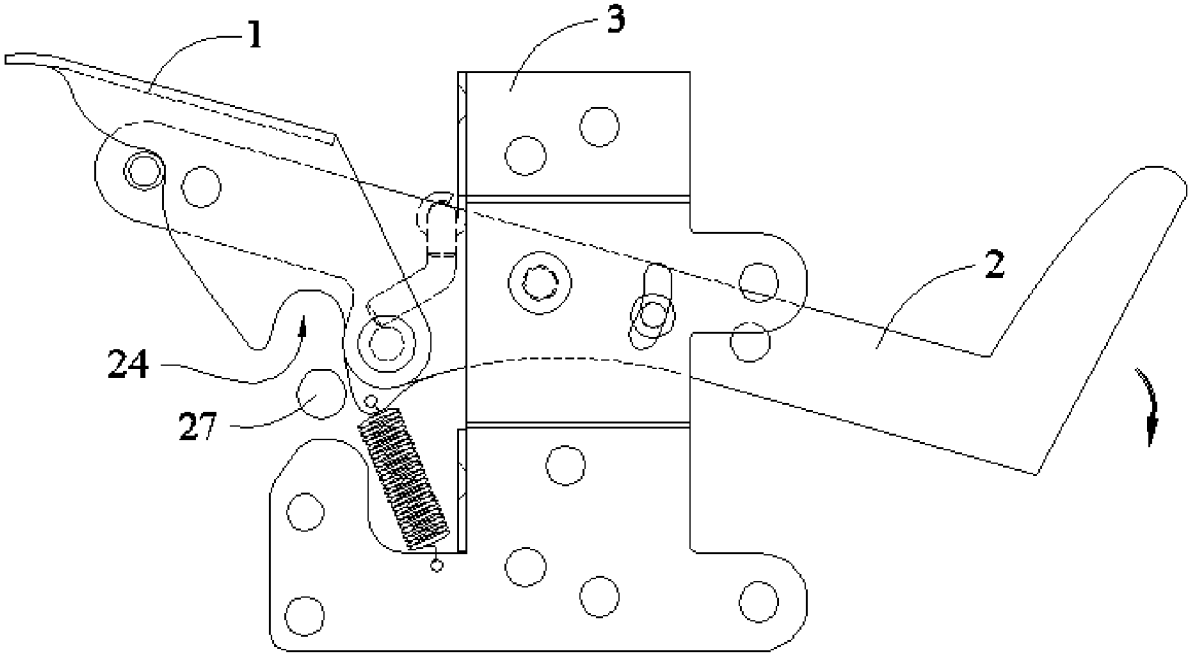
FIG. 3 is a 2-dimensional view showing both latch-hook bracket and handle bar being swung out of latched position.

FIGS. 1, 2 and 3 show the first gate latch embodiment. FIG. 1 shows the gate latch in latched position having a latch-hook bracket 1 pivotably attached to the inside portion of the handle bar 2 where the pivot hole 4 on the latch-hook bracket 1 is axially aligned with the pivot hole 6 on the handle bar 2. A rivet or bolt 28 is fastened to pivotably install the latch-hook bracket 1 to the handle bar 2 at the aligned through hole 4 and through hole 6. The through hole 5 on the latch-hook bracket 1 is axially aligned with through hole 7 on the handle bar 2 where a padlock by third party (not shown) can hook into. When a padlock is hooked into though hole 5 and 7 while the secondary locking bolt 16 is actuated, a person on the outside the fence would not be able to use any means to swing the latch-hook bracket 1 upwardly. A spoon-like plate 19 is an extended portion of the latch-hook bracket 1 so that the user can lift the latch-hook bracket 1 upwardly away from the locking bolt 27 (as seen on FIG. 2). When the latch-hook bracket 1 is lifted upwardly while the handle bar 2 still remains in place, the gate can be opened when the locking-bolt pocket 24 is swung away from the locking bolt 27 (as seen on FIG. 2). Pivot hole 13 on the base bracket 3 is aligned axially with a pivot hole (not shown) on the handle bar 2 where bolt 17 is fastened into which is the pivot point for the handle bar 2 to partially swings about the horizontal axis. Stop rod 20 is incorporated onto the inside portion of the handle bar 2 so that the latch-hook bracket 1 can rest onto which is when the through hole 5 and 7 aligned axially. Oblong hole 14 on the base bracket 3 is aligned with hole (not shown) on the handle bar 2 where bolt 18 is fastened onto the handle bar 2 directly and loose enough to slide along the oblong hole 14 on the base bracket 3. Through hole 8 on the base bracket 2 is aligned axially with through hole 9 on the handle bar 2 which is used for a padlock to hook into, or through hole 9 of the handle bar 2 is for an incorporated lock to be installed having a locking bolt when actuated would protrude into through hole 8 on the base bracket 3 for locking the gate latch from outside. Said through hole 8 may become a key-hole-like through hole so that the locking bolt (not shown) protruded from the incorporated lock (not shown) would hook onto the key-hole-like portion which prevent the handle bar 2 from being bent away. A padlock by third party (not shown) can be hooked into through hole 11 on the outside of the gate or hole 10 on the inside of the gate for the purpose of holding the padlock for convenience. An extended handle-bar member 30 is projected vertically, horizontally or upwardly at an angle for the user to easily and comfortable actuate the gate latch. The base bracket 3 has a projected portion forming a channel 29 for the handle bar 2 to partially swing within. A sleeve 15 on the inside portion of the base bracket 3 is incorporated for a secondary locking bolt 16 to slide horizontally over the handle bar 2 as an optional feature which helps preventing the handle bar 2 from being actuated by someone on the outside the gate using means such as a stick or string loop to pull the latch-hook bracket 1 upward. The inside portion of the base bracket 3 has an extended portion forming a locking-bolt stop 26 which helps preventing the latch-hook bracket 1 from being lifted out of the locking bolt 27 (shown on FIG. 2). Multiple through holes 12 are for screws or bolts to fasten the base bracket 3 onto the fence gate or gate frame. An extension spring 23 is utilized to help bringing the inside portion of the handle bar 2 and latch-hook bracket 1 downwardly when the extension spring 23 is hooked onto through hole 22 on the handle bar 2 and through hole 21 on the base bracket 3.

FIG. 2 shows side view of the gate latch having the latch-hook bracket 1 swung upwardly away from the locking bolt 27 while the handle bar 2 remains in horizontal position in relation to the base bracket 3. Through hole 5 on the latch-hook bracket 1 is swung away from though hole 7 on the handle bar 2. The recess portion 31 on the latch-hook bracket 1 is also swung away from the stop bar 20 on the inside portion of the handle bar 2.

Figure 4:
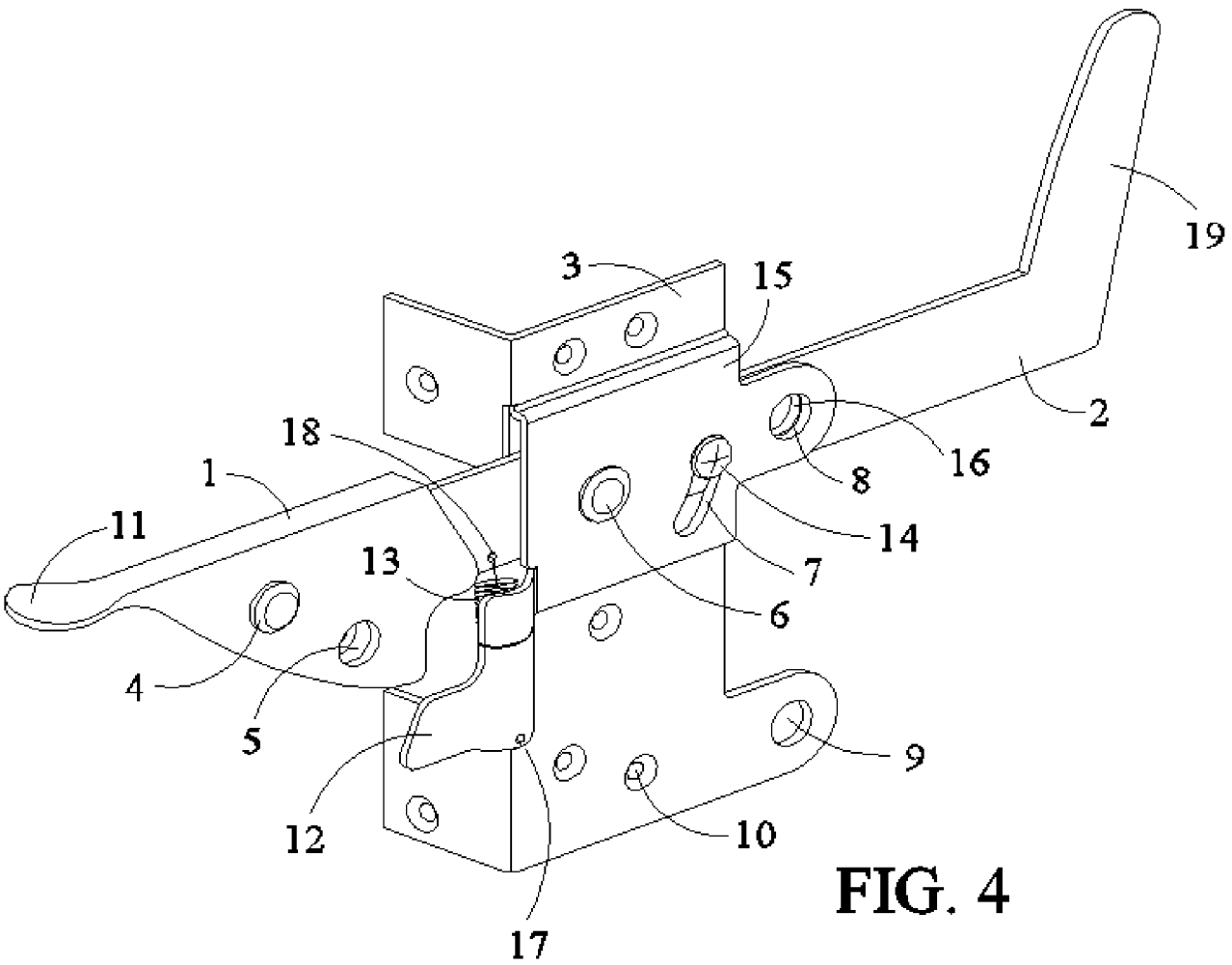
FIG. 4 is a dimetric view of the gate latch showing three major components including latch-hook bracket, handle bar and base bracket in latched position. The pivot point of the latch-hook bracket is positioned toward the front end of the handle bar on the inside of the gate.
Figure 5:
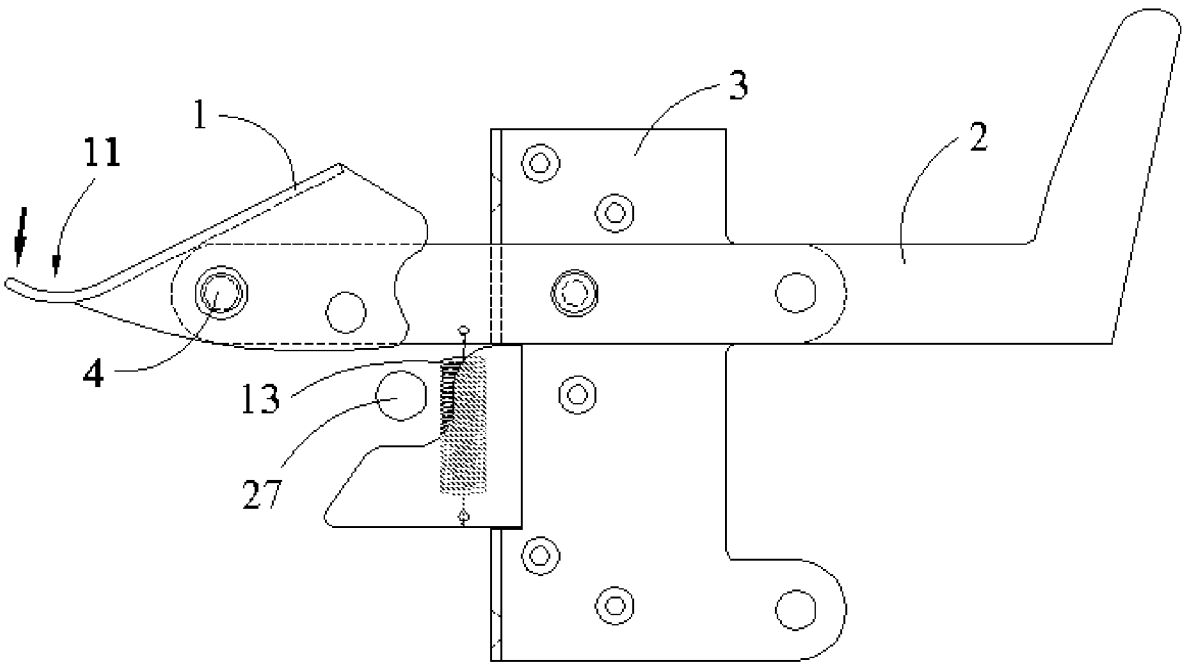
FIG. 5 is a 2-dimensional view showing the latch-hook bracket being swung out of latched position when the inside portion of the latch-hook bracket is pressed downwardly.
Figure 6:
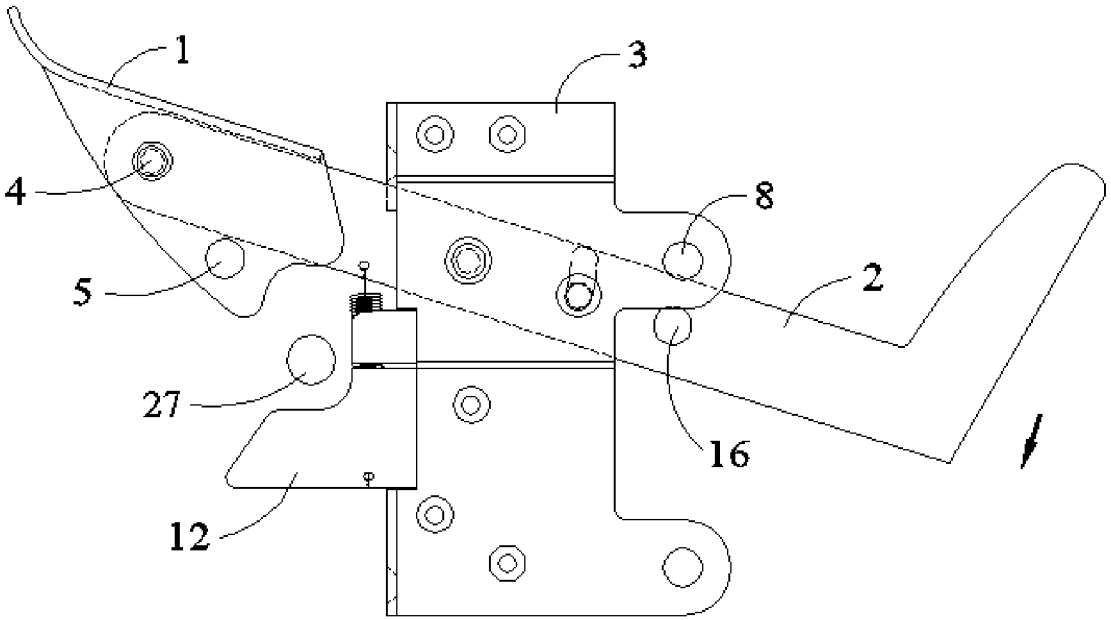
FIG. 6 is a 2-dimensional view showing both latch-hook bracket and handle bar being swung out of latched position.

FIG. 3 shows the handle bar 2 is actuated from outside the gate by pulling the handle bar 2 downwardly which swings the inside portion of the handle bar 2 and the latch-hook bracket 1 upwardly. The locking-bolt pocket 24 on the latch-hook bracket 1 is swung away from the locking bolt 27. The extension spring 23 (as seen on FIG. 1) hooked onto the inside portion of the base bracket 3 at through hole 21 and through hole 22 on the handle bar 2 which helps providing tension for the inside portion of the handle bar 2 to swing into latched position. FIGS. 4, 5 and 6 show the second gate latch embodiment. FIG. 4 shows the gate latch in latched position having a latch-hook bracket 1 pivotably attached to the inside end portion of the handle bar 2 where a rivet or bolt 4 is axially aligned and fastened into the pivot holes (not shown) on the latch-hook bracket 1 and pivot hole (not shown) on the handle bar 2. A spoon-like plate 11 is an extended portion of the latch-hook bracket 1 where the user can push downwardly in order to swing the back portion of the latch-hook bracket 1 upwardly away from the latch bolt 27 (as seen on FIGS. 5 and 6). The handle bar 2 is pivotably attached to the base bracket 3 by a rivet or bolt 6 where the pivot hole (not shown) on the handle bar 2 and pivot hole (not shown) on the base bracket 3 are aligned axially. Through holes 5 on the latch-hook bracket 1 is used for a padlock by third party (not shown) to hook into. The inside portion of the base bracket 3 has an extended portion forming a locking-bolt stop 12 which helps preventing the latch-hook bracket 1 from being lifted out of the locking bolt 27 (shown on FIGS. 5 and 6). In this configuration having a locking-bolt stop 12, the locking bolt 27 can only slide horizontally which is installed on the adjacent structure. The extended portion of the base bracket 3 having a through hole 17 for the lower portion of the extension spring 13 to hook into, and the upper portion of the extension spring 13 hooks into through hole 18 on the inside portion of the handle bar 2 where the extension spring 13 is utilized to help bringing the inside portion of the handle bar 2 and latch-hook bracket 1 downwardly into the latch-able position. Oblong hole 7 on the base bracket 3 is aligned with hole (not shown) on the handle bar 2 where bolt 14 is fastened onto the handle bar 2 directly and loose enough to slide along the oblong hole 7 on the base bracket 3. Through hole 8 on the base bracket 2 is aligned axially with through hole 16 on the handle bar 2 which is used for a padlock (not shown) to hook into, or through hole 16 on the handle bar 2 is for an incorporated lock to be installed having a locking bolt when actuated would protrude into through hole 8 on the base bracket 3 for locking the gate latch from outside the gate. A padlock by third party (not shown) can be hooked into through hole 9 on the outside of the gate for the purpose of holding the padlock for convenience. An extended handle-bar member 19 is projected vertically, horizontally or upwardly at an angle for the user to easily and comfortably actuate the gate latch. The base bracket 3 has a projected portion forming a channel 15 for the handle bar 2 to partially swing within. Multiple through holes 10 are for screws or bolts to fasten the base bracket 3 onto the fence gate or gate frame.

FIG. 5 shows a spoon-like plate 11 is an extended portion of the latch-hook bracket 1 where the user can push downwardly in order to swing the back portion of the latch-hook bracket 1 upwardly away from the latch bolt 27 which is installed on the adjacent structure. When the spoon-like plate 11 is pushed downwardly, the back portion of the latch-hook bracket 1 would swing upwardly while the handle bar 2 still remains in place, the gate can be opened when the latch-hook bracket 2 is swung upwardly away from the locking bolt 27 even when the handle bar 2 is locked on the outside with the base bracket 3. The inside portion of the handle bar 2 would swing downwardly by having an extension spring 13 hooked onto the handle bar 2 and the inside portion of the base bracket 3 (shown on FIG. 4). Pivot holes 4 having a bolt fastened may include a torsion spring (not shown) to help the latch-hook bracket 1 swinging downwardly instead of being swung downwardly due to gravity.

FIG. 6 When the handle bar 2 is pulled downwardly from outside the gate, the inside portion of the handle bar 2 would raise the latch-hook bracket 1 upwardly away from the locking bolt 27 to be out of the latched position. A rivet or a bolt 4 is fastened into the through holes (not shown) on the latch-hook bracket 1 and the inside end portion of the handle bar 2 so that the latch-hook bracket 1 can pivotably swing upwardly and downwardly when the spoon-like plate (shown on FIGS. 4 and 5) is pushed down or released. Though hole 5 is for a padlock (not shown) to hook into which would help preventing someone on outside of the gate from using any means to unlatch the latch-hook bracket 1 when the outside is locked. Through hole 8 on the base bracket 3 and through hole 16 on the handle bar 2 are out of alignment as when the handle bar 2 is swung downwardly. An incorporated lock with key or combination code can be installed at through hole 8 or 16 depending on the configuration whether the handle bar 2 or the base bracket 3 is on the exposed side. A secondary locking bolt (not shown) may be utilized to prevent the inside portion of the handle bar 2 from being swung upwardly when the gate latch is not locked on the outside.

Figure 7:
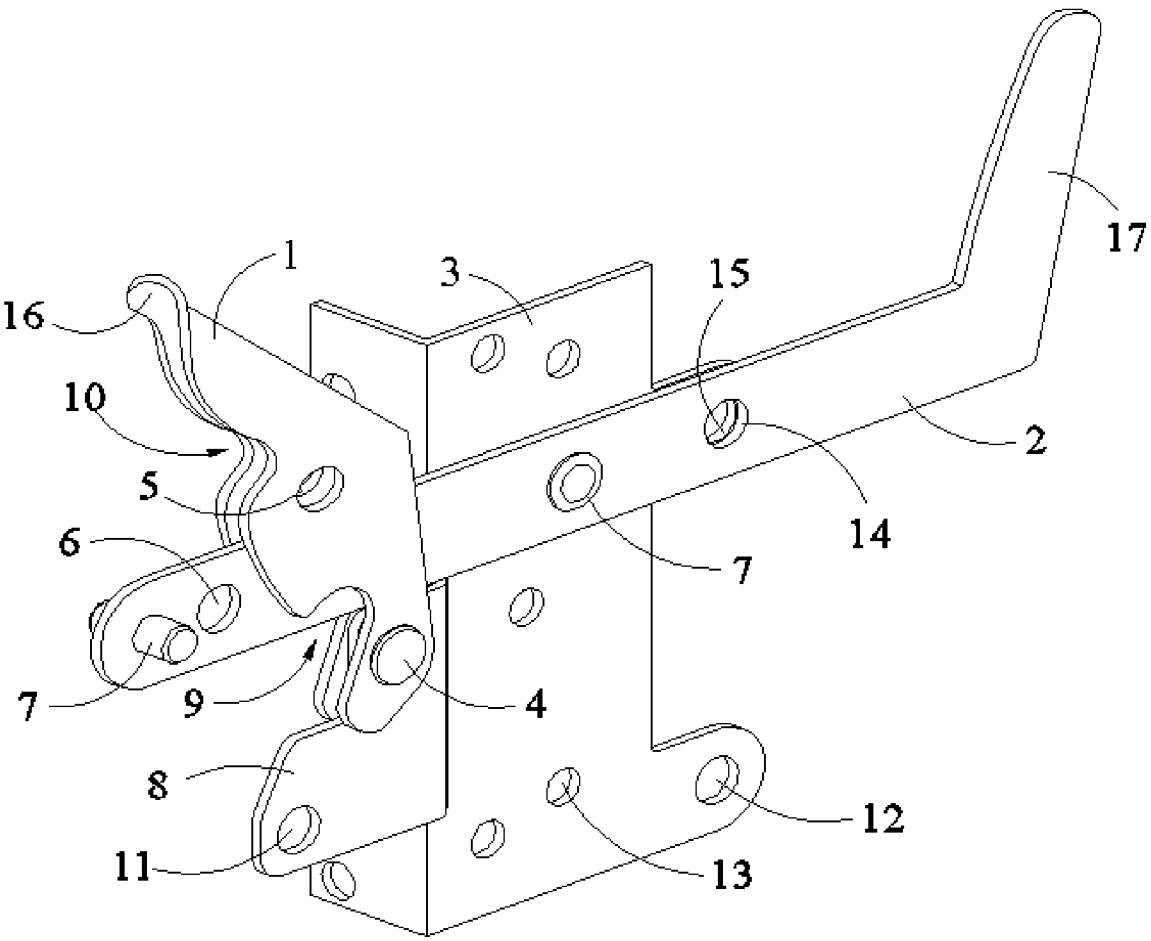
FIG. 7 is a dimetric view of the gate latch showing 3 major components including latch-hook bracket, handle bar and base bracket when the latch-hook bracket is swung upwardly out of latched position.
Figure 8:
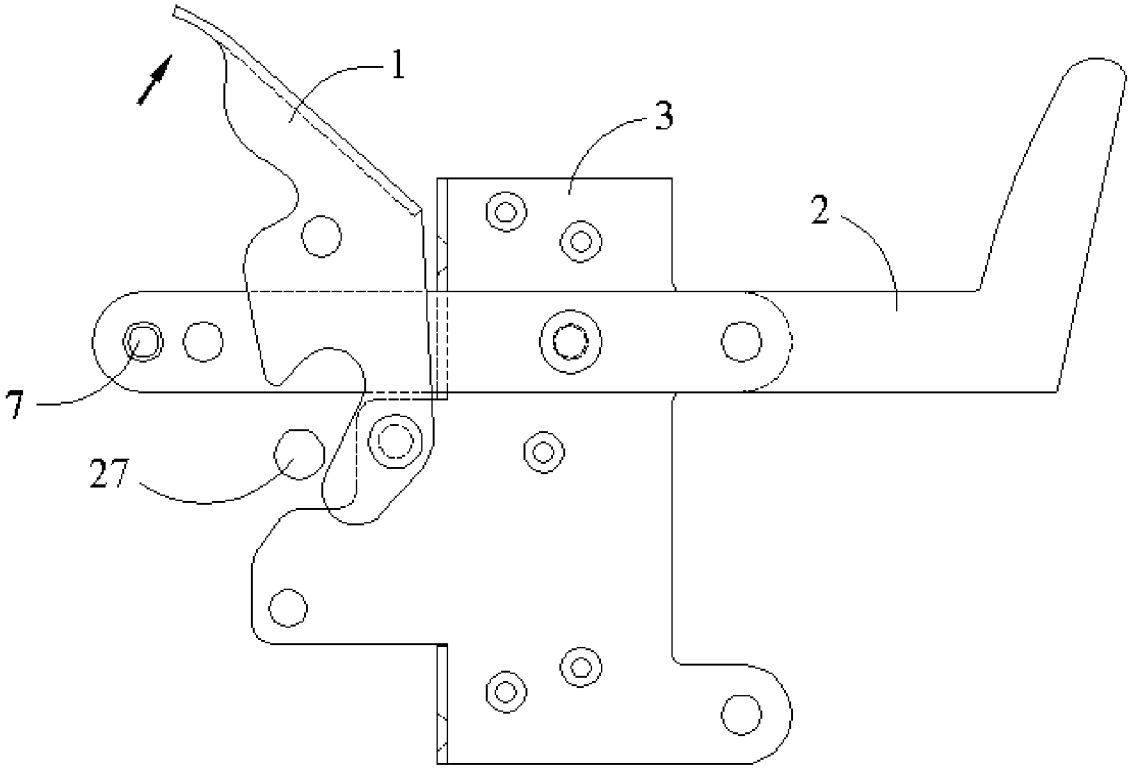
FIG. 8 is a 2-dimensional view showing the latch-hook bracket is swung upwardly.
Figure 9:
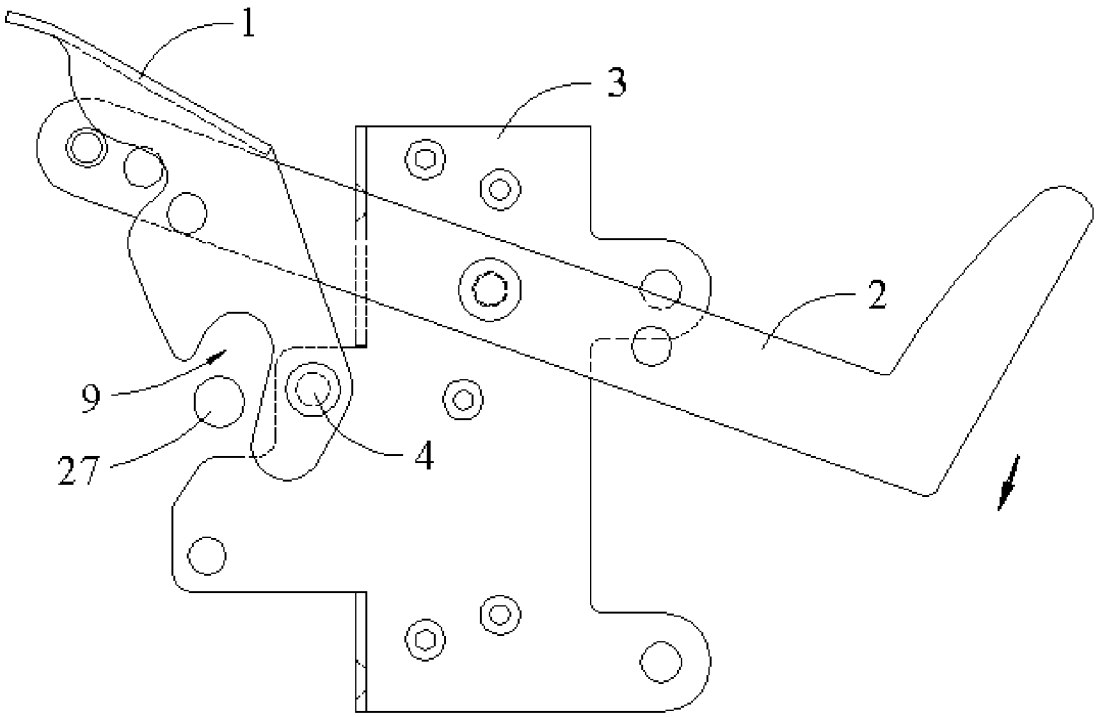
FIG. 9 is a 2-dimensional view showing both latch-hook bracket and handle bar are swung to raise the latch-hook bracket upwardly.

FIGS. 7, 8 and 9 show the third gate latch embodiment. FIG. 7 shows the gate latch having the latch-hook bracket 1 pivotably attached to the inside portion of the base bracket 3 where a rivet or bolt 4 is fastened into the pivot hole (not shown) on the latch-hook bracket 1 and the pivot hole (not shown) on the inside extended portion of the base bracket 3. The latch-hook bracket 1 is pivotably swung upward to raise the locking-bolt pocket 9 away from the locking bolt 27 (shown on FIGS. 8 & 9) while the handle bar 2 remains in place as if the handle bar 2 is locked on the outside at though hole 14 on the handle bar 2 and through hole 15 on the base bracket 3. Through hole 5 on the latch-hook bracket 1 is axially aligned with through hole 6 on the handle bar 2 where a padlock by third party (not shown) can hook into when the latch-hook bracket is swung back into the latched position. Through hole 5 and 6 are axially aligned to have a padlock by third party (not shown) hooked into so that a person on the inside the fence can lock the gate and the person on the outside of the gate cannot open the gate. A recess portion 10 on the latch-hook bracket 1 is positioned to rest onto the stop bar 7 when the latch-hook bracket 1 is in latched position which also set through hole 5 and through hole 6 in axially aligned position for a padlock to hook into. A spoon-like plate 16 is an extended portion of the latch-hook bracket 1 so that the user can lift the latch-hook bracket 1 upwardly away from the locking bolt 27 (as shown on FIGS. 8 and 9) which is when the locking-bolt pocket 9 on the latch-hook bracket 1 swung away from the locking bolt 27 (as seen on FIGS. 8 and 9). Pivot bolt 7 is installed to pivotably fasten the handle bar 2 to the base bracket 3 which is aligned axially with a pivot hole (not shown) on the handle bar 2 and the inside portion of the base bracket 3 where the handle bar 2 is partially swings partially up and down. Stop rod 7 is incorporated onto the inside end portion of the handle bar 2 so that the latch-hook bracket 1 can rest onto which is when the through hole 5 and 6 aligned axially. Through hole 15 on the base bracket 3 is aligned axially with through hole 14 on the handle bar 2 which is used for a padlock (not seen) to hook into, or through hole 15 of the base bracket 3 is for an incorporated lock to be installed having a locking bolt when actuated would protrude into through hole 14 on the handle bar 2 for locking the gate latch from outside. A padlock by third party (not shown) can be hooked into through hole 12 on the outside of the gate or through hole 11 on the inside of the gate for the purpose of holding the padlock for convenience. An extended handle-bar member 17 is projected vertically, horizontally or upwardly at an angle for the user to comfortably actuate the gate latch on the outside of the gate. The inside portion of the base bracket 3 has an extended portion forming a locking-bolt stop 8 which helps preventing the latch-hook bracket 1 from being lifted out of the locking bolt 27 (shown on FIGS. 8 and 9). Said extended portion forming a locking-bolt stop 8 would allow the locking bolt 27 to slide back and forth horizontally from the latch bolt installed on the adjacent structure from the gate latch. Multiple through holes 13 are for screws or bolts to fasten the base bracket 3 onto the fence gate or gate frame. A torsion spring (not shown) may be utilized to help bringing the inside portion of the handle bar 2 and/or the latch-hook bracket 1 downwardly when the torsion spring (not shown) is installed as part of the pivot bolt 4 and/or an extension spring (not shown) is installed to pull the handle bar 2 into latched position.

FIG. 8 shows side view of the gate latch having the latch-hook bracket 1 swung upwardly away from the locking bolt 27 while the handle bar 2 remains in horizontal position in relation to the base bracket 3. The recess portion 10 on the latch-hook bracket 1 is also swung away from the stop bar 7 on the inside end portion of the handle bar 2. The locking-bolt pocket 9 on the latch-hook bracket 1 is lifted away from the locking bolt 27 so that the gate can be in the openable position.

FIG. 9 shows the handle bar 2 is actuated from outside the gate by pulling the handle bar 2 downwardly which swings the inside portion of the handle bar 2 and the latch-hook bracket 1 upwardly so that the locking-bolt pocket 9 is swung away from the locking bolt 27. A rivet or bolt 4 is the pivot axis of the pivot hole on the latch-hook bracket and the pivot hole on the base bracket 3.

Figure 10:
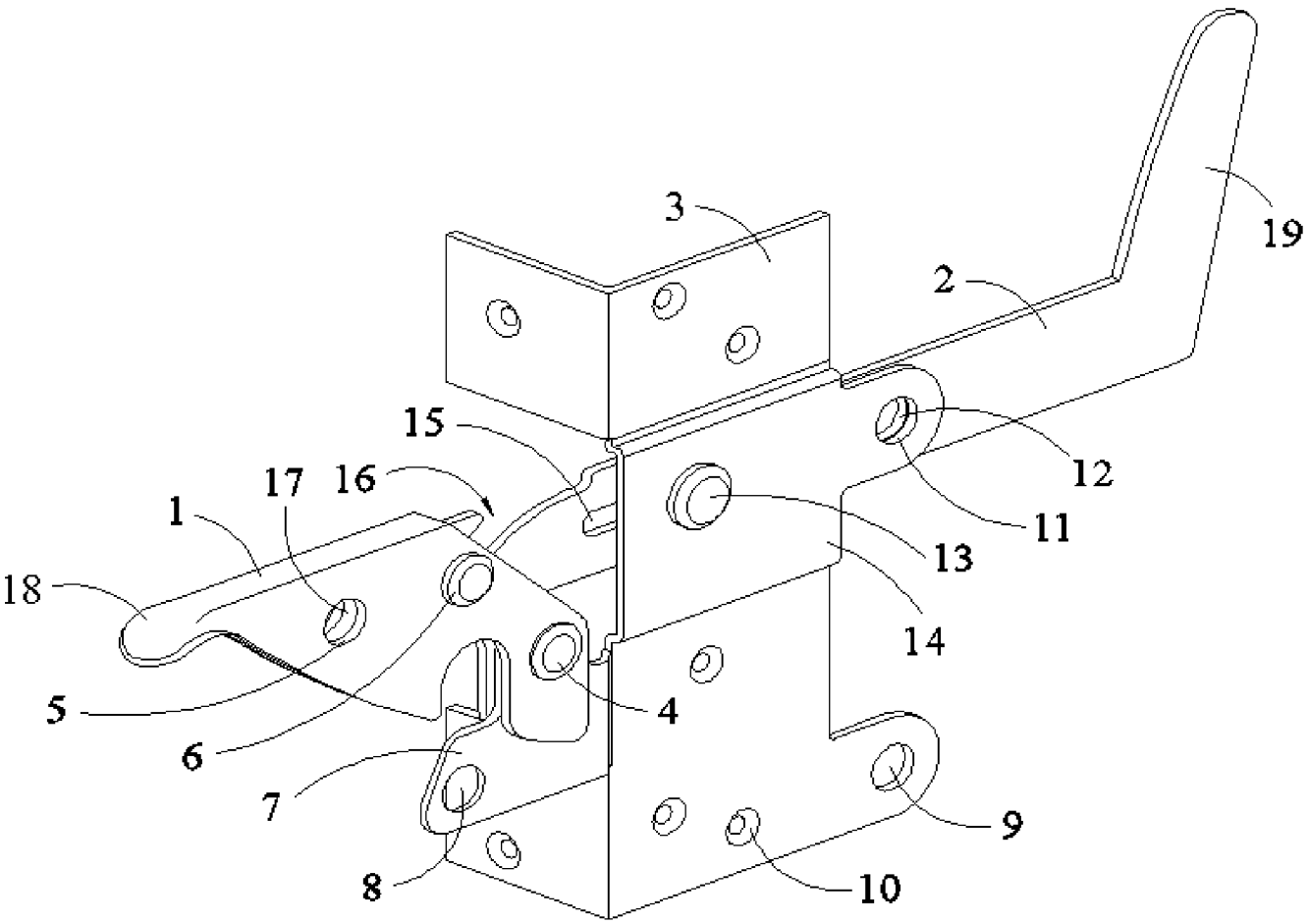
FIG. 10 is a dimetric view of the gate latch showing 3 major components including latch-hook bracket, handle bar and base bracket when the latch-hook bracket is in latched position.
Figure 11:
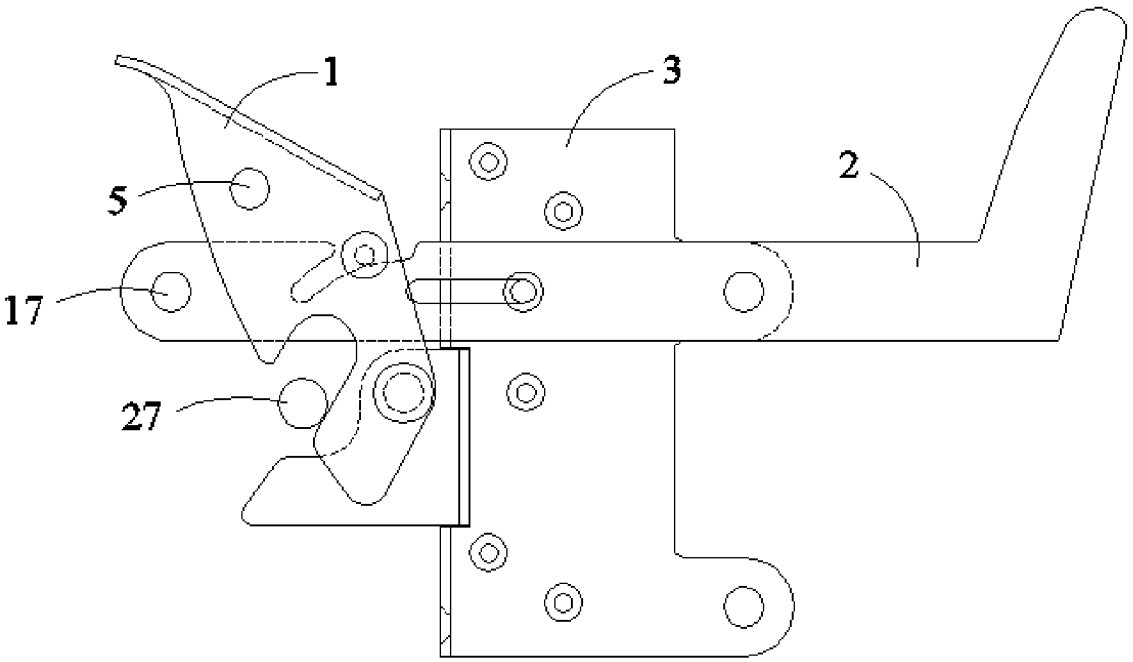
FIG. 11 is a 2-dimensional view showing the latch-hook bracket is swung upwardly.
Figure 12:
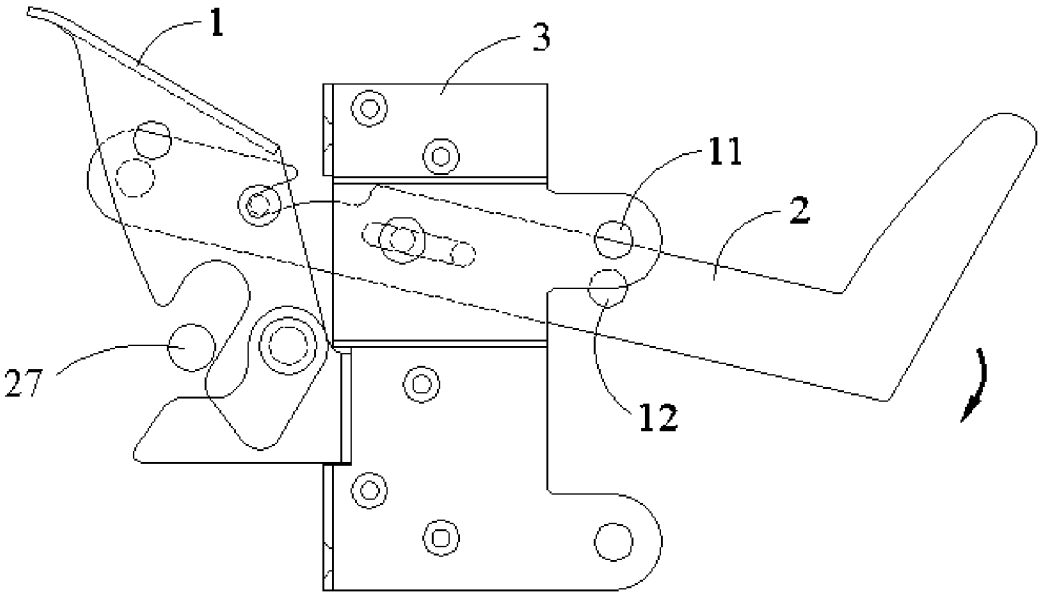
FIG. 12 is a 2-dimensional view showing the handle bar pulled the latch-hook bracket upwardly out of latched position.

FIGS. 10, 11 and 12 show the fourth gate latch embodiment. FIG. 10 shows the gate latch in latched position having the latch-hook bracket 1 pivotably attached to the inside portion of the base bracket 3 where a rivet or bolt 4 is fastened into the pivot hole (not shown) on the latch-hook bracket 1 and the pivot hole (not shown) on the inside extended portion of the base bracket 3. When the latch-hook bracket 1 is pivotably swung upward by lifting the spoon-like plate 18 upwardly to swing the latch-hook bracket 1 away from the locking bolt 27 (shown on FIG. 11) while the handle bar 2 remains in place as if the handle bar 2 is locked on the outside at though hole 12 on the handle bar 2 and through hole 11 on the base bracket 3. When the handle bar 2 is actuated from outside the fence by pulling the handle bar 2 outwardly, the cut-a-way sliding channel 15 on the handle bar 2 would be the range limit allowed where the pivot bolt 13 slides within, and the cut-away open channel 16 would hook onto the rivet 6 on the latch-hook bracket 1 and pull the latch-hook bracket 1 pivotably upward to be out of latched position. Through hole 5 on the latch-hook bracket 1 is axially aligned with through hole 17 on the handle bar 2 where a padlock by third party (not shown) can hook into when the latch-hook bracket 1 is swung back into latched position so that a person on the inside the fence can lock the gate and the person on the outside of the gate cannot open the gate. A spoon-like plate 18 is an extended portion of the latch-hook bracket 1 so that the user can lift the latch-hook bracket 1 upwardly away from the locking bolt 27 (as shown on FIG. 11) which is when the latch-hook bracket 1 swung away from the locking bolt 27 (as seen on FIGS. 11 and 12). Pivot bolt 13 is installed to pivotably fasten the handle bar 2 to the base bracket 3 which is aligned axially with a pivot hole (not shown) on the handle bar 2 and pivot hole on the base bracket 3. Base bracket 3 having a channel 14 for the handle bar 2 to slide and partially swing within. Through hole 11 on the base bracket 3 is aligned axially with through hole 12 on the handle bar 2 which is used for a padlock (not seen) to hook into, or through hole 12 of the handle bar 2 is for an incorporated lock to be installed having a locking bolt when actuated would protrude into through hole 11 on the base bracket 3 for locking the gate latch from outside. A padlock by third party (not shown) can be hooked into through hole 9 on the outside of the gate or through hole 8 on the inside of the gate for the purpose of holding the padlock for convenience. An extended handle-bar member 19 is projected vertically, horizontally or upwardly at an angle for the user to comfortably actuate the gate latch on the outside of the gate. The inside portion of the base bracket 3 has an extended portion forming a locking-bolt stop 7 which helps preventing the latch-hook bracket 1 from being lifted away from the locking bolt 27 (shown on FIGS. 11 & 12). Said extended portion forming a locking-bolt stop 7 would allow the locking bolt 27 protruded from the latch bolt installed on the adjacent structure to slide horizontally from the extended position or the retracted position. Multiple through holes 10 are for screws or bolts to fasten the base bracket 3 onto the fence gate or gate frame. A torsion spring (not shown) may be utilized to help swinging the inside portion of the handle bar 2 or the latch-hook bracket 1 downwardly when the torsion spring (not shown) is installed as part of the pivot bolt 4 and/or an extension spring (not shown) is installed on the outside of the gate or inside of the gate for the purpose of pulling the handle bar 2 into latched position.

FIG. 11 shows side view of the gate latch having the latch-hook bracket 1 swung upwardly away from the locking bolt 27 while the handle bar 2 remains in horizontal position in relation to the base bracket 3. Through hole 5 on the latch-hook bracket 1 is swung away from though hole 17 on the inside end portion of the handle bar 2. The latch-hook bracket 1 is swung upwardly so that the gate can be in the openable position.

FIG. 12 shows the handle bar 2 is actuated from outside the gate by pulling and swinging the handle bar 2 outwardly and downwardly which swings the inside portion of the handle bar 2 and the latch-hook bracket 1 upwardly bringing the latch-hook bracket 1 out of latched position and be able to swing away from the locking bolt 27. Through hole 11 on the base bracket 3 and through hole 12 on the handle bar 2 can be used for a padlock by third party (not shown) or an incorporated lock installed which is lockable by a key or combination coded when they are axially aligned.

Figure 13:
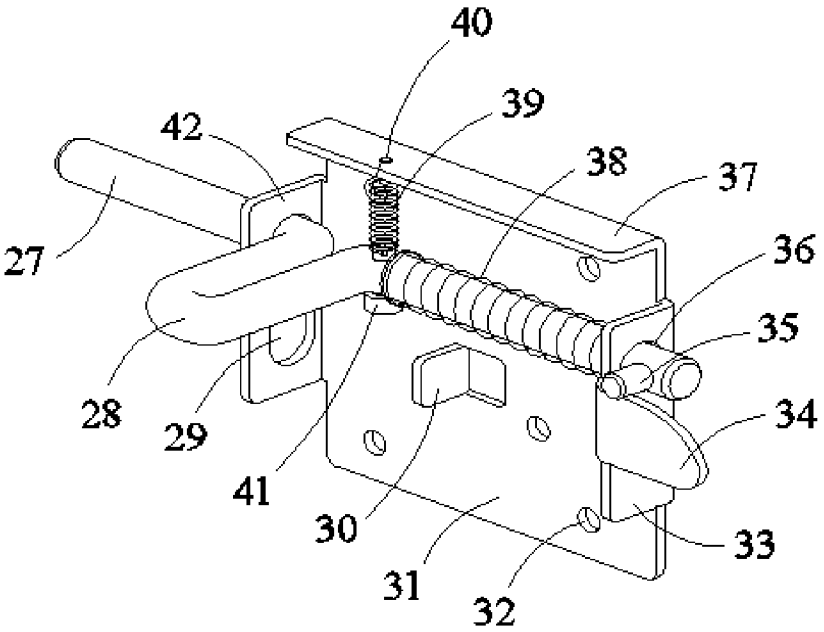
FIG. 13 is a dimetric view of the latch bolt showing a locking bolt, a base housing and 2 springs.

FIG. 13 shows a latch bolt mechanism having a base wall panel 31 with multiple screw holes 32; first extended wall panel 42 having an oblong hole 29 for the locking bolt 27 sliding horizontally to achieve latching or unlatching action or partially swinging downwardly to be out of latched position; second extended wall panel 33 having a hole 36 to hold the end portion of the locking bolt 27; a stop bolt 35 is installed to the back end portion of the locking bolt 27 to slide over the guild plate 34 which helps keeping the handle member 28 in horizontal position; handle member 28 can be configured to swing downwardly by having the stop bolt 35 slides behind the guild plat 34; third extended wall panel 37 having a through hole 40 for the upper end of the extension spring 39 to hook into and the bottom portion of the extension spring 39 is hooked onto the locking bolt 27 in order to hold the locking bolt 27 upwardly; the compression spring 38 is installed to keep the locking bolt 27 protruded fully. The locking bolt 27 is configured to slide horizontally and/or turn axially in extended or retracted position. The locking bolt 27 can also be arranged to lock in position and not to swing downwardly when the gate latch having at least one locking bolt stop 41 which prevent the locking bolt from swinging downwardly and/or horizontally.

The intended application for the multi-function latch and latch bolt is for installation on a gate, storage barn door, or the like, to prevent intruders or unauthorized persons from entering into an enclosed area. Providing access to certain person does not mean that one must have the gate unlocked. Leaving the gate unlocked may mean an easy access for unauthorized persons. Providing the degree of security necessary, ease of use, reliability, low cost, convenience, and providing easy access to authorized persons by having a gate latch installed with novel multi-function latch and latch bolt installed.

Although the present invention herein has been described with reference to particular embodiments, it is to be understood that these embodiments are merely illustrative of the principles and methods of the present invention. It is therefore to be understood that numerous modifications may be made to the illustrative embodiments and that other arrangements may be devised without departing from the spirit and scope of the present invention as defined by the appended claims.

What is claimed is:

1. A gate latch and latch bolt comprising: a latch-hook bracket being pivotably attached to an inside portion of a handle bar, where the latch-hook bracket is configured to be actuated by a portion of the handle bar on an outside and/or an inside of a gate; said latch-hook bracket is partially swingable along an axis of a pivot hole on the handle bar; said latch-hook bracket having a first plate on top, at least one vertical plate bent or connected perpendicularly from the first plate; said first plate having an extended portion having a spoon-like plate incorporated for actuating the latch-hook bracket from the inside of the gate; said latch-hook bracket is self-latched when the gate is swung into a closed position; said latch-hook bracket is pivotably attached to the handle bar by an extended bolt through said pivot hole; said extended bolt having a torsion spring helping the latch-hook bracket to swing toward a latchable position; said latch-hook bracket is configured to partially swing upward and downward for the purpose of engaging or disengaging from a locking bolt in order to latch or unlatch and to be able to close or open the gate from the inside or the outside of the gate even when the gate latch is locked on the outside of the gate; when the handle bar is unlocked and is able to be swung downwardly from the outside the gate, a portion of the handle bar on the inside of the gate would pivotably swing upward, thereby also swinging the latch-hook bracket out of the latchable position in order for the gate to be openable; said handle bar being pivotably attached to a base bracket at a threaded bolt hole of the base bracket; said handle bar having the inside portion configured to actuate the latch-hook bracket and having at least one through hole for a padlock; said handle bar having an outside portion having at least one through hole for at least one removable padlock; said handle bar having at least one spring through hole for at least one extension spring to hook into; when the latch-hook bracket is lifted out of the latchable position, the handle bar remains in a horizontal position whether the outside of the gate latch is locked or not, when the outside of the gate latch is not locked, the inside portion of the handle bar would be able to swing or lift upwardly which also swings the latch-hook bracket out of the latchable position; when the handle bar is locked on the outside of the gate, the inside portion of the handle bar remains in the horizontal position, however the latch-hook bracket is still swingable to be unlatched for the gate to be openable; said handle bar is pivotably attached to the base bracket at a handle pivot hole on the handle bar and the threaded bolt hole on the base bracket; said handle bar being flat, and having a bent or projected portion extended vertically, upwardly at an angle or horizontally on the outside of the gate; said base bracket having a main plate, at least one extended plate bent from or connected perpendicular to the main plate, at least one extended portion on a same plane as the main plate and/or parallel with the main plate, and multiple through holes; said main plate having the handle bar pivotably installed thereto as the threaded bolt hole is located on the main plate; said base bracket having at least one spring hole for the extension spring to hook into in order for the extension spring to pull the handle bar and/or latch-hook bracket downwardly to the latchable position; said multiple through holes are for screws and/or bolts/nuts to be fastened through and into the gate or a fence structure, said base bracket is fixedly installed to an edge of the gate and configured to swing about a vertical axis or fixedly installed on the fence structure; said main plate being configured with a center portion projecting outwardly forming a channel in which the handle bar is pivotably installed onto an inside of the channel portion; a top portion and a bottom portion of the main plate are on the same plane, where ones of the multiple through holes are arranged for the screws and/or bolts/nuts to be fastened through and into the gate or the fence structure; said latch bolt having a base housing, a locking bolt and at least one spring; said base housing having at least one main panel, at least two extended panels projecting perpendicularly from the main panel and at least one secondary extended panel projecting perpendicularly from an extended panel; said first extended panel in a front portion of the locking bolt having a round through hole or an elongated through hole; said second extended panel in the rear portion of the locking bolt having a round through hole; said base housing having at least one holding panel extended from the main panel and projected perpendicularly from the main panel; said at least one holding panel is for the locking bolt to be held in a retracted position preventing the locking bolt from engaging with the latch-hook bracket or for the locking bolt to be held in fully extended position which is when the locking bolt is in a position to be engageable with the latch-hook bracket; said secondary extended panel is utilized to prevent the locking bolt from turning when the locking bolt is in the fully extended position; said locking bolt being configured to slide horizontally away from the latch-hook bracket and/or pivotably swing downward away from the latch-hook bracket; said locking bolt having a bent portion forming a locking-bolt handle or a handle bolt installed onto the locking bolt configured for a person to hold and actuate the locking bolt; said at least one spring is an extension spring and/or compression spring utilized to push the locking bolt horizontally toward the latch-hook bracket and hold the locking bolt horizontally; said locking bolt is configured with the base housing so that the locking bolt is locked into the fully extended position or a retracted position.

2. The gate latch and latch bolt of claim 1, wherein the handle bar having the bent or projected portion, said bent or projected portion is an extended plate and/or cylindrical rod attached forming at least one secondary handle-bar member extended vertically and/or horizontally; said secondary handle-bar member extending upwardly on the outside and/or horizontally on the inside of the handle bar.

3. The gate latch and latch bolt of claim 2, wherein said secondary handle-bar member projects vertically or upwardly at an angle between 10 degrees and 60 degrees from the vertical axis; said secondary handle-bar member projects upwardly and is configured to be utilized for left-hand-swing and/or right-hand-swing gates.

4. The gate latch and latch bolt of claim 1, wherein the base bracket further comprises a secondary locking bolt incorporated onto an inside portion of the base bracket to prevent the handle bar from being actuated from the outside the gate when the padlock is not used on the inside of the gate.

5. The gate latch and latch bolt of claim 1, wherein the base bracket further comprises an incorporated lock attached on an outside of the base bracket; said incorporated lock being configured to prevent the handle bar from being actuated when locked; said incorporated lock is set to be locked or unlocked by a key or combination codes.

6. The gate latch and latch bolt of claim 1, wherein the latch-hook bracket comprises a double-hook structure having the first plate on the top, the at least one vertical plate comprising a second plate on a left side and a third plate on a right side; said first plate having an extended portion forming the spoon-like plate incorporated for lifting the latch-hook bracket pivotably upward; said second plate and third plate are connected perpendicularly to the first plate and extended vertically in the downward direction from first plate; said second plate and third plate having substantially identical profiles with surfaces and contours that are parallel with each other; said second plate and third plate forming a passage in between so that the inside portion of the handle bar can be inserted, pivotably attached and partially swingable in between the second plate and third plate; said double-hook structure with the second plate and the third plate having first through holes that are horizontally and axially aligned with said pivot hole on the handle bar where the latch-hook bracket is pivotably fastened to the handle bar; said double-hook structure with the second plate and the third plate having second through holes that are horizontally and axially aligned with one of the through holes on the handle bar where the padlock can be hooked into preventing the latch-hook bracket from swinging upwardly out of the latchable position; said double-hook structure having first side-by-side hollowed-out portions forming a double catch tongue profile on the second plate and the third plate for the locking bolt to be engaged in when latched; said double-hook structure having second side-by-side hollowed-out portions forming a double-recessed profile on the second plate and the third plate for a stop rod installed on the handle bar to detachably hold the latch-hook bracket in a rest position.

7. The gate latch and latch bolt of claim 1, wherein the latch-hook bracket comprises a single-hook structure having the first plate on the top, the at least one vertical plate comprising a second plate on a left side and a third plate on a right side; said first plate having an extended portion forming the spoon-like plate incorporated for lifting the latch-hook bracket pivotably upward; said second plate and third plate are connected perpendicularly to the first plate and extended vertically in the downward direction from first plate; said second plate and third plate having substantially identical profiles with surfaces and contours that are parallel with each other; said second plate and third plate forming a passage in between so that the inside portion of the handle bar can be inserted, pivotably attached and partially swingable in between second plate and third plate; said single-hook structure with the second plate and the third plate having first through holes that are horizontally and axially aligned with said pivot hole on the handle bar where the latch-hook bracket is pivotably fastened to the handle bar; said single-hook structure with the second plate and the third plate having second through holes that are horizontally and axially aligned with one of the through holes on the handle bar where the padlock can be hooked into preventing the latch-hook bracket from swinging upwardly out of latched position; said single-hook structure having one of the second plate and the third plate having a first hollowed-out portions forming a catch tongue profile on the second plate or the third plate for the locking bolt to be engaged in when latched; said single-hook structure having a second hollowed-out portion forming a single-recessed profile on the second plate or the third plate for a stop rod installed on the handle bar to detachably hold the latch-hook bracket in a rest position.

8. The gate latch and latch bolt of claim 1, wherein the latch-hook bracket further comprises a double-hook structure having first through holes aligned with the pivot hole on the inside portion of the handle bar where the double-hook structure is pivotably attached to the handle bar; said double-hook structure having second through holes positioned under the inside portion of the handle bar for the padlock to hook into when needed; when the spoon-like plate which is extended from the first plate is pushed downwardly, a back side of the latch-hook bracket near the locking bolt would swing upwardly which moves the latch-hook bracket upwardly to set the gate latch in the closed position.

9. The gate latch and latch bolt of claim 1, wherein the latch-hook bracket further comprises a double-hook structure having first through holes aligned with the pivot hole of the handle bar where the double-hook structure is pivotably attached thereto; said double-hook structure having second through holes positioned between the pivot hole and the spoon-like plate; said second though holes are aligned horizontally and axially with the through hole on the inside portion of the handle bar for the padlock to hook into when needed; when the spoon-like plate which is extended from the first plate is pushed downwardly, a back side of the latch-hook bracket near the locking bolt would swing upwardly which moves the latch-hook bracket upwardly to set the gate latch in the closed position.

10. The gate latch and latch bolt of claim 1, wherein the latch-hook bracket further comprises a single-hook structure having the first plate on the top, with the at least one vertical plate comprising a second plate on a left side or on a right side; said first plate having the extended portion forming the spoon-like plate incorporated for pushing the latch-hook bracket pivotably downward; said second plate or third plate is connected perpendicularly to the first plate and extended vertically in the downward direction from the first plate; said latch-hook bracket with single-hook structure having a first hollowed-out portion forming a catch tongue profile on the second plate or third plate for the locking bolt to be engaged in when latched.

11. The gate latch and latch bolt of claim 1, wherein having configurations for installation onto an inswing or outswing gate or fence edge, left hand or right hand operation and/or upside down installation; said configurations having the latch-hook bracket positioned on the inside of the gate and/or the outside of the gate is actuated independently by the handle bar to latch or unlatch when both sides of the handle bar are unlocked.

12. A gate latch comprising: a latch-hook bracket being pivotably attached to an extended portion of a base bracket on an inside or outside of a gate where the latch-hook bracket is located, the latch-hook bracket being actuated by a handle bar on the outside and/or inside of the gate; said latch-hook bracket is partially swingable along an axis of a pivot hole on the extended portion of the base bracket; said latch-hook bracket having a first plate on top, at least one vertical plate bent or connected perpendicularly from the first plate; said first plate having an extended portion having a spoon-like plate incorporated for actuating the latch-hook bracket from the inside of the gate; said latch-hook bracket is self-latched when the gate is swung into a closed position; said latch-hook bracket is pivotably attached to the extended portion of the base bracket by a rivet, bolt/nut or an extended bolt through the pivot hole; said rivet, bolt/nut or extended bolt having a torsion spring helping the latch-hook bracket to swing toward a latchable position; said latch-hook bracket is configured to partially swing upward and downward for the purpose of engaging or disengaging from a locking bolt in order to latch or unlatch and be able to close or open the gate from the inside of the gate even when the gate latch is locked on the outside; when the handle bar is unlocked and is able to swing downwardly from the outside the gate, a portion of the handle bar on the inside of the gate would pivotably swing upward, thereby swinging the latch-hook bracket out of latchable position in order for the gate to be openable; said handle bar being pivotably attached to an exposed surface of the base bracket at the pivot hole; said handle bar having an inside portion configured to actuate the latch-hook bracket and having at least one inside through hole for a padlock; said handle bar having an outside portion configured to have at least one outside through hole for at least one removable padlock; said handle bar having at least one spring through hole for the torsion spring to hook into; when the latch-hook bracket is being lifted out of latchable position, the handle bar remains in a horizontal position whether an outside of the gate latch is locked or not; when the outside of the gate latch is not locked, the inside portion of the handle bar would be swingable or liftable upwardly which also swings the latch-hook bracket out of the latchable position; when the handle bar is locked on the outside of the gate, the inside portion of the handle bar remains in horizontal position, however the latch-hook bracket is still swingable to be unlatched for the gate to be openable; said handle bar is pivotably attached to the exposed surface of the base bracket at the pivot hole near a middle of the handle bar and the pivot hole on the base bracket; said handle bar being flat, and having a bent or projected portion extended vertically, upwardly at an angle or horizontally on the outside of the gate; said base bracket having a main plate, the extended portion being bent from or connected perpendicular to the main plate, the extended portion is on the same plane as the main plate and/or parallel with the main plate; said extended portion having the pivot hole for pivotably attaching the latch-hook bracket on the inside of the gate; said extended portion also configured to function as a stop for the locking bolt and also having a though hole for the padlock to hook into; said main plate having the handle bar pivotably installed thereto by the aligned pivot hole which is located on the main plate; said base bracket having at least one spring hole for the torsion spring to hook into in order for the torsion spring to pull the handle bar and/or the latch-hook bracket downwardly to the latchable position; said base bracket having multiple through holes for screws and/or bolts/nuts to be fastened through and into the gate or a fence structure, said base bracket is configured to be fixedly installed to an edge of the gate swinging about a vertical axis or fixedly installed to the fence structure; said base bracket having the multiple through holes for the screws and/or bolts/nuts to be fastened through and into the edge of the gate or the fence structure.

13. The gate latch of claim 12, said bent or projected portion projected upwardly at an angle between 10 degrees and 60 degrees from the vertical axis.

14. The gate latch of claim 12, wherein the base bracket having a secondary locking bolt incorporated on the inside of the gate where a secondary locking bolt slides horizontally over the handle bar and is configured to prevent the handle bar from being swung upwardly by a person on the outside of the gate.

15. A gate latch comprising: a latch-hook bracket pivotably attached to an inside portion of a base bracket and rotatably hooked to an inside portion of a handle bar which is partially sliding and swinging when actuated; said latch-hook bracket is self-latched when a gate is swung into a closed position; said latch-hook bracket having a double-hook structure comprising a first plate on top, a second plate on a left side and a third plate on a right side; said first plate having an extended portion having a spoon-like plate incorporated for lifting the latch-hook bracket pivotably upward to unlatch or pushing the latch-hook bracket pivotably downward to latch; said second plate and third plate are connected perpendicularly to said first plate and extended vertically in the downward direction from first plate; said second plate and third plate having a substantially identical profile with surfaces and contours that are parallel with each other; said second plate and third plate forming a passage in between so that the inside portion of the handle bar pivotably slides and partially swings in between said second plate and said third plate of the double-hook structure; said double-hook structure with said second plate and said third plate having first through holes that are horizontally and axially aligned with a first through hole on the inside portion of the base bracket where the latch-hook bracket is pivotably fastened to the base bracket; said double-hook structure with said second plate and said third plate having second through holes that are horizontally and axially aligned with a second through hole near a front end of the handle bar where a padlock is hooked for preventing the latch-hook bracket from swinging upwardly out of a latched position; said double-hook structure having third through holes that are horizontally and axially aligned with a rivet or bolt installed and hooked onto the inside portion of the handle bar; said double-hook structure having first side-by-side hollowed-out portions forming a double catch tongue profile on said second plate and said third plate for a locking bolt to be engaged in when the latch-hook bracket is in the latched position; said latch-hook bracket having at least one hole available for at least one spring to hook into; said handle bar having an elongated cut-a-way sliding channel, and a cut-a-way open channel; said inside portion of the handle bar is positioned in between the second and the third plate of the double-hook structure where the cut-a-way open channel has a hook-like member on the inside portion of the handle bar hooked onto the rivet or bolt fastened at the third though holes on the double-hook structure; said elongated cut-a-way sliding channel is fastened to the base bracket; said handle bar is pivotably attached and/or slidably attached to the base bracket; said latch-hook bracket is swung upwardly when the handle bar is slightly swung downwardly and pulled simultaneously; said base bracket having at least one extended portion on the inside portion where the first through hole is located, said cut-a-way channel on the handle bar forming the hook-like member for pulling the latch-hook bracket upwardly; said base bracket having an extended lower portion on the outside of the base bracket for the padlock to hook onto; said base bracket having multiple installation through holes.

* * * * *